United States Patent [19]

Miles

[11] 4,221,553

[45] * Sep. 9, 1980

[54] ORBITAL PUMP WITH FLUID FLOW CONTROL

[76] Inventor: Edward J. Miles, 1960 Port Claridge Pl., Newport Beach, Calif. 92660

[ * ] Notice: The portion of the term of this patent subsequent to Jun. 27, 1995, has been disclaimed.

[21] Appl. No.: 904,389

[22] Filed: May 10, 1978

Related U.S. Application Data

[63] Continuation-in-part of Ser. No. 760,273, Jan. 18, 1977, Pat. No. 4,097,205.

[51] Int. Cl.[3] ..... F04C 18/00; F04C 27/00

[52] U.S. Cl. ..... 418/61 R; 418/137; 418/144; 418/148; 418/255

[58] Field of Search ..... 418/61 R, 64, 136, 144, 418/148, 186, 255, 137; 123/242, 243

[56] References Cited

U.S. PATENT DOCUMENTS

| | | | |
|---|---|---|---|
| 2,423,507 | 7/1947 | Lawton | 418/61 R |
| 3,314,401 | 4/1967 | Kell | 123/242 |
| 3,318,291 | 5/1967 | Hallenbeck et al. | 418/61 R |
| 3,332,403 | 7/1967 | Reller | 418/61 B |
| 3,787,150 | 1/1974 | Sarich | 418/61 R |
| 4,097,205 | 6/1978 | Miles | 418/61 R |

FOREIGN PATENT DOCUMENTS

| | | | |
|---|---|---|---|
| 551202 | 5/1932 | Fed. Rep. of Germany | 123/242 |
| 2449706 | 4/1975 | Fed. Rep. of Germany | 418/61 R |
| 405010 | 7/1966 | Switzerland | 418/61 R |
| 19777 | of 1904 | United Kingdom | 418/61 R |

*Primary Examiner*—John J. Vrablik

*Attorney, Agent, or Firm*—Gary Appel

[57] ABSTRACT

An orbital pump comprises a pump housing having first and second end walls and an intermediate annular, inwardly projecting wide wall member. First and second axial drive shaft portions are installed through corresponding housing end walls. A rotor, excentrically rotatably mounted to inner ends of the drive shaft portions, is installed in the housing with first and second rotor end flanges adjacent to the corresponding sides of the annular wall member so that the pump end walls, annular wall member and rotor end flanges divide the housing into an inlet plenum, a generally square compression chamber and an outlet plenum. A pair of orthogonally intersecting vanes mounted through the rotor divide the compression chamber into four pumping sub-chambers, ends of each vane being orthogonal to opposite sides of the compression chamber, and in tangential sliding contact therewith. As the rotor, which is constrained to orbital movement by bell crank means, orbits the compression chamber, inlet and outlet parts to and from the pumping chambers are sequentially uncovered and covered to enable pumping. Alternatively, poppet valves may be provided for controlling flow into and out of the pumping chambers.

8 Claims, 29 Drawing Figures

POSITION 1 - 0° START

POSITION 2 - 90° ADVANCE

POSITION 3 - 180° ADVANCE

POSITION 4 - 270° ADVANCE

POSITION 1 - 0° START

POSITION 2 - 90° ADVANCE

POSITION 3 - 180° ADVANCE

POSITION 4 - 270° ADVANCE

FIG. 19
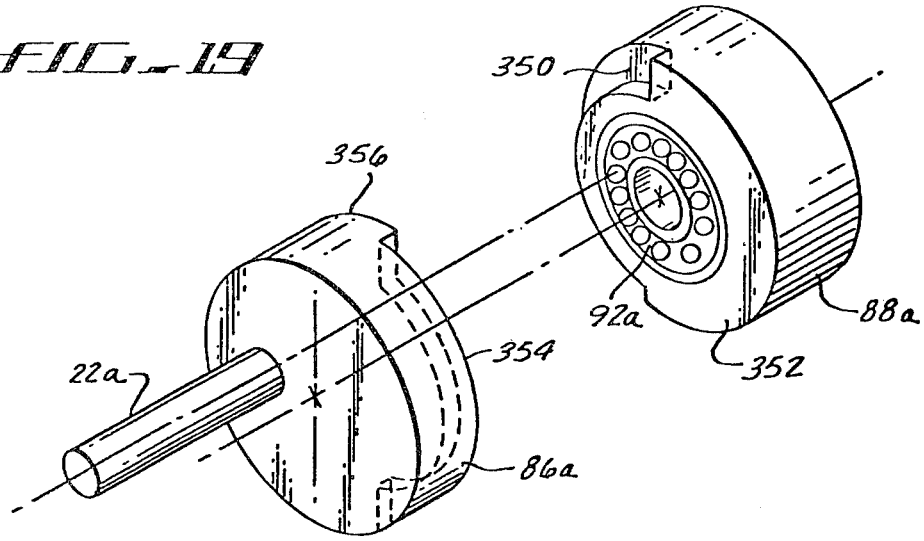
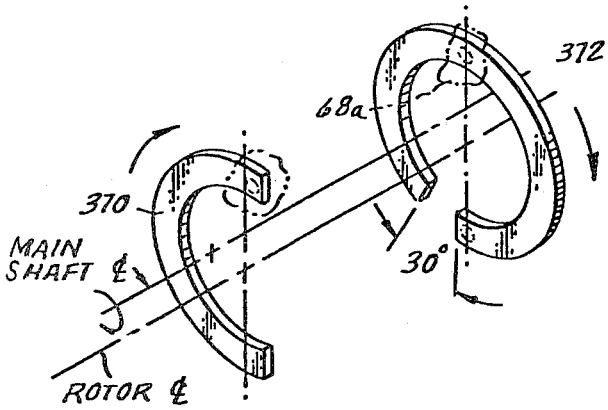
FIG. 20A
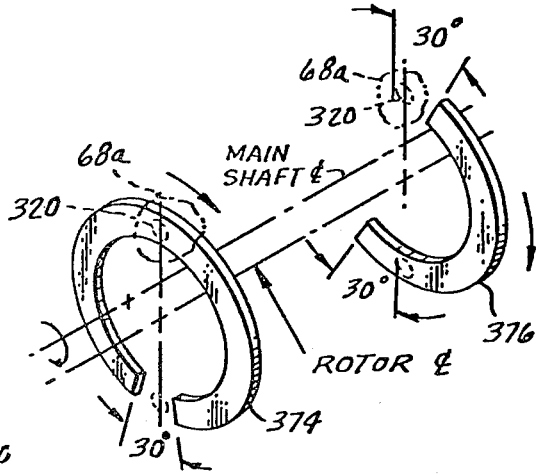
FIG. 20B
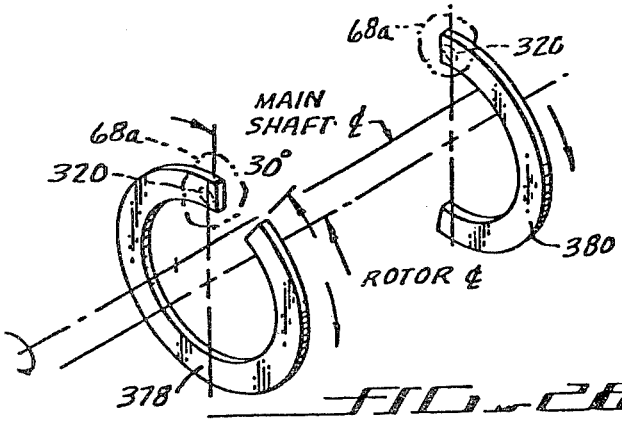
FIG. 20C

POSITION 1 - 0° START

POSITION 2 - 90° ADVANCE

POSITION 3 - 180° ADVANCE

POSITION 4 - 270 ADVANCE

POSITION 1 - 0° START

POSITION 2 - 90° ADVANCE

POSITION 3 - 180° ADVANCE

POSITION 4 - 270° ADVANCE

ORBITAL PUMP WITH FLUID FLOW CONTROL

This is a continuation-in-part of Patent Application Ser. No. 760,273, filed on Jan. 18, 1977 and now issued in June 27, 1978 as U.S. Pat. No. 4,097,205.

BACKGROUND OF THE INVENTION

1. Field of the Invention:

The present invention related to the field of pumps.

2. Description of the Prior Art:

Several different types of fuel combustion engines have been offered as alternatives to the familiar, reciprocating piston-type internal combustion engines, such as are universally used in automobiles, motorcycles, small airplanes, etc. One of the reasons these alternatives have been proposed is that piston-type engines are relatively inefficient, at least partly the result of having to convert linearly reciprocating piston motion into rotary crank shaft movement. Another reason is that the ratio of piston engine weight to output (brake) horsepower is relatively unfavorable for many applications.

Of these proposed alternatives, gas turbine engines have proven more successful, replacing piston engines in many applications, such as in aircraft, where high power and low weight to horsepower ratios are essential. Nevertheless, because of high cost and various problems, turbine engines have not, for example, proven competitive with piston engines for most other uses, including automotive use, due at least partly to general economy of, and satisfaction with, piston engines for these applications, with consequent lack of turbine engine development effort in these areas.

Also seriously proposed as an alternative to the piston engine, or in many instances a supplement to such engines, are rotary or orbital engines. Rotary engines can be divided into two sub-types—the Wankel rotary piston engine employing a triangular rotor which functions much like a piston in a reciprocating engine, and vane-type, orbital or concentric rotating engines which ordinarily employ a number of vanes radially sliding from a rotor to circumferentially divide a large central chamber into a number of smaller working chambers which are compressed and expanded as the rotor orbits the combustion chamber. When the rotor is driven, instead of being used to drive, for example, a drive shaft, and with relatively minor modifications as alternatives, the orbital or rotary "engine" can be utilized as an orbital or rotary pump. Thus, in most respects, discussion of an orbital and rotary combustion engines can be considered to apply, as well, to the corresponding orbital and rotary pumps, with advantages of such engines and pumps being generally similar. Exemplary of rotary engines are the patent disclosures of Hoffman, Hutsell, Vawter, Howitt et al., Chkliar, Rhine, Kelly and Bentley (U.S. Pat. Nos. 1,121,628; 1,269,937; 1,303,134; 1,354,189; 2,179,401; 2,302,254; 3,452,725 and 3,762,375, respectively).

In general, rotary engines differ from reciprocating piston engines in that the high pressure gases created by combustion of a fuel-air mixture in each of the working chambers in sequence drives the rotor in an orbital direction around the central chamber or concentric with the chamber, the rotor in turn causing rotation of the crank shaft to which it is connected. There is no linear reciprocating movement, as is present in piston-type engines, which must be converted to rotary shaft movement.

Thus, at least in concept, concentric rotary or orbital engines (and pumps) are comparatively simple, and Wankel engines have achieved some success, particularly as automobile engines for Mazda automobiles. However, because of relatively high fuel consumption, high exhaust emission of air pollutants and relatively low reliability and short life, in spite of initial good engine performance, use of Wankel engines has been limited and interest in this type engine has currently greatly diminished in the face of fuel shortages, high fuel costs and stringent exhaust emission standards.

A major problem, if not the major problem, with rotary engines (and pumps) has been sealing between the rotor or rotor vanes and inner housing walls which form the combustion (or pumping) chamber. In piston-type engines sealing is relatively easy and straightforward—each cylinder is constructed to be entirely separate and the cylindrical portions which slide linearly in cylindrical chambers are relatively easily sealed by one or more circular piston rings. However, in rotary engines (and pumps) each of the several working chambers are separated only by contact between edges of the rotor or rotor vanes and the engine housing inner walls. The high pressure differential across these contact regions, between adjacent working chambers makes sealing very difficult. When sliding vanes are used with the rotor, as they are in orbital-type or concentric rotating rotary engines (and pumps), large bending moments are applied to the vanes by high pressure combustion gases (or pumped fluids including gases). This tends not only to inhibit free sliding of the vanes radially in and out of the rotor as the rotor orbits about its chamber, as is necessary to maintain sliding engagement with the housing walls, but also to damage the vanes.

Furthermore, the inner housing walls are generally constructed with a non circular transverse cross section such that the rotor or vane contact regions change their angle of contact as the rotor revolves concentrically or orbits about the chamber. This adds to the side loading of vanes and greatly enhances the difficulty of sealing between the rotor or vanes and the housing walls. Resultant leakage of high pressure combustion gases (or fluids being pumped) from one working chamber to adjacent chambers causes loss of compression and exhaust emission of improperly combusted fuel (or low pumping pressures).

In addition to problems with sealing, there are substantial difficulties with valving combustion air into, and exhaust gases from, the working chambers of rotary-type engines (and similarly with valving of fluid inlet and outlet to the chamber for pumps). Such valving is less straightforward in rotary engines (and pumps) than in piston engines because of orbital or rotary movement of the rotor.

Although, at least in theory, rotary and orbital type engines (and pumps) appear to offer substantial advantages over piston type internal combustion engines (and conventional pumps), for reasons including those set forth above, such engines (and corresponding pumps) heretofore available have been costly to produce, have required frequent repairing and have been generally unsatisfactory. As a result, substantial improvements to rotary and orbital engines (and pumps) are required before their full potential can be realized.

SUMMARY OF THE INVENTION

An orbital type pump comprises a generally cylindrical (engine) housing having a circumferential wall portion and first and second transverse end walls, and having disposed between the end walls, in mutual, axial spaced relationship, an annular wall member inwardly projecting from the circumferential wall portion. The pump includes a generally spool shaped rotor having a central portion and first and second ends which include, respectively, first and second outwardly projecting, annular flanges. The rotor is configured and disposed in the housing to have first and second side surfaces of the rotor flanges in close proximity to corresponding first and second side surfaces of the annular housing wall member. A (combustion) air plenum is formed between the housing first end wall and the rotor first end and the first annular wall member, an exhaust gas plenum is formed between the housing second end wall and the rotor first end and the second annular wall member, and a central chamber being formed between the first and second rotor flanges.

A drive shaft, journaled for axial rotation in the housing, has portions extending to axial ends of the rotor. Connecting means are provided for rotatably connecting these ends of the rotor to the extending portions of the drive shaft with the rotational axis of the rotor laterally offset from the rotational axis of the drive shaft. In consequence, as the rotor rotates about the drive shaft, it orbits about the central chamber.

A plurality of rotor vanes are radially mounted and slide through the rotor dividing the central chamber into a circumferential plurality of subchambers which change volume as the rotor orbits around the central chamber. Means are included for controlling inlet flow of fluids and gases into the pumping subchambers and for controlling outlet discharge of fluids and gases from the pumping subchambers.

Means are provided for contraining the rotor against rotational movement so that the rotor orbits around the central chamber.

Said means for controlling inlet flow and outlet discharge of fluids and gases to and from the pumping subchambers may comprise a plurality of spring loaded inlet and outlet poppet valves.

Alternatively, an inlet plenum is formed between the housing first end wall and the rotor first side surface and the first wall member side surface and an outlet plenum is formed between the housing second end wall and the rotor second end surface and the second wall member side surface.

Included are means of defining a plurality of passages through the rotor communicating between the inlet and outlet plenums and the subchambers, each passage communicating with a different one of the subchambers and having an inlet end at the first rotor end and an outlet end at the second rotor end. The flow control means are associated with the drive shaft for causing closing of the inlet ends of preselected ones of the passages at first preselected rotor orbital positions and for closing of the outlet ends of preselected ones of the passages at second preselected rotor orbital positions.

The central chamber is formed with a generally square transverse cross section with first and second opposing pairs of inner wall surfaces. The rotor vanes comprise first and second rotor vanes which project through the rotor and are mutually orthogonal and are orthogonal to corresponding pairs of the inner wall surfaces. The first vane is formed in a central region to enable the second vane to slide there through, the vanes dividing the central chamber into four subchambers. The rotor is configured and mounted so that at all rotor orbital positions the vanes remain orthogonal to the corresponding inner wall surfaces. Ends of the vanes reciprocate tangentially along such surfaces as the rotor orbits about the central chamber.

Seals installed along edges of the vanes, between the vanes and the rotor, where the vanes pass through the rotor, and between the rotor flanges and adjacent annular wall member prevent pressurized gas leakage between the subchambers and into other portions of the housing, including the inlet and outlet plenums.

Because the seals at the ends of the rotor vanes always slide tangentially along parallel inner wall surfaces of the central chamber sealing between the vanes and housing is simple and effective and no springs are required to urge the vanes outwardly against the housing walls.

BRIEF DESCRIPTION OF THE DRAWINGS

A better understanding of the present invention may be had from a consideration of the following detailed description, taken in conjunction with the accompanying drawings, in which:

FIG. 19 is a perspective drawing of the fluid pump drive shaft portions to which the rotor is connected;

FIG. 28 is a perspective view of three means for controlling the opening and closing of rotor openings, FIG. 28*a* showing such means for a gas compressor apparatus, FIG. 28*b* showing such means for a gas expander apparatus and FIG. 28*c* showing such means for a vacuum pump.

DESCRIPTION OF THE PREFERRED EMBODIMENT

Figure 1:
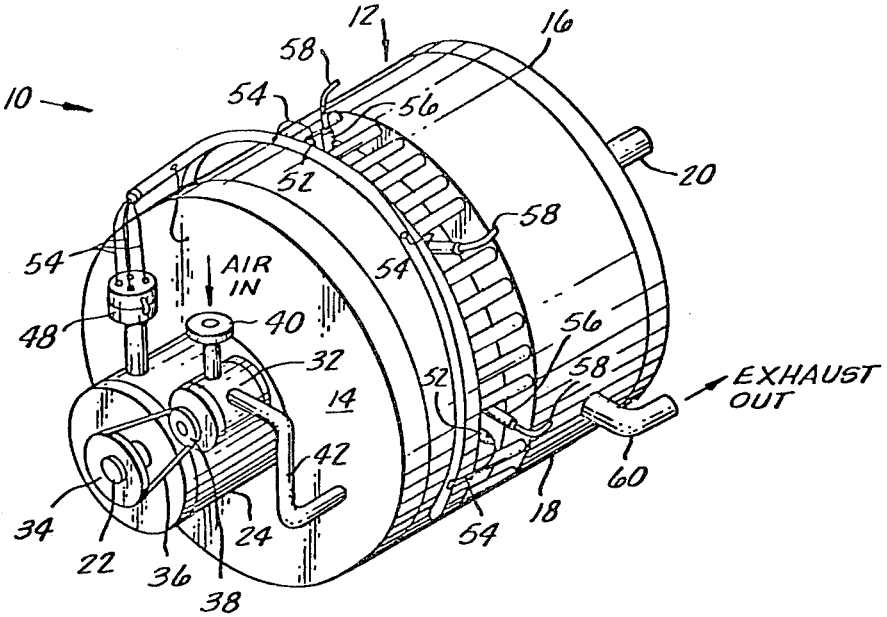
FIG. 1 is a perspective drawing showing external features of an orbital engine according to the preferred embodiment.

As seen in FIG. 1, a orbital-type engine 10, which may also sometimes be considered a rotary engine, comprises a generally cylindrical housing 12 having a first, combustion air inlet end wall 14, a second exhaust gas outlet end wall 16 and a circumferential wall portion 18 therebetween. As more particularly described below, a main drive shaft portion 20 projects axially outwardly through the second end wall 16; an accessary drive shaft portion 22 projects axially outwardly through the first end wall 14 into an accessory housing 24. As illustrated, the engine 10 is based on the Otto Cycle consisting of two isotropic and two constant volume processes.

Associated with the housing 12 is an air blower or pump 32, driven by the accessory shaft portion 22, through a drive shaft pulley 34 fixed thereto and a drive belt 36 entrained over outer blower pulley 38. Combustion air, entering the air blower 32 through an air inlet 40, is delivered slightly pressurized into the housing 12 via an air supply line 42. Also associated with the housing 12 is a generally conventional spark distributor 48 driven in a well known manner, by a bevel gear 50 (FIG. 2) fixed to the accessory shaft portion 22 within the accessory housing 24. Not shown is a fuel pump a coolant pump and an oil pump, all of which may also be driven by the accessory or by main drive shaft portion 20 or 22.

A plurality of spark plugs 52, connected to the distributor 48 by wires 54 are provided for combustion purposes and a like plurality of fuel, injectors 56, connected by fuel lines 58 to a fuel pump provide fuel, for example, gasoline, to the engine 10. An exhaust gas outlet manifold or line 60 is provided for discharging combustion gases from the engine 10.

Figure 2:
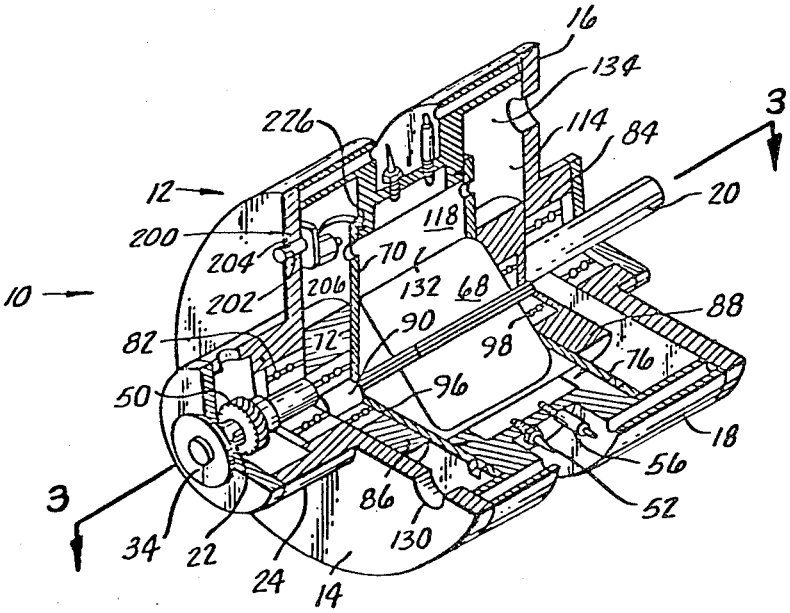
FIG. 2 is a cut away perspective drawing, showing internal features of the orbital engine of FIG. 1.
Figure 3:
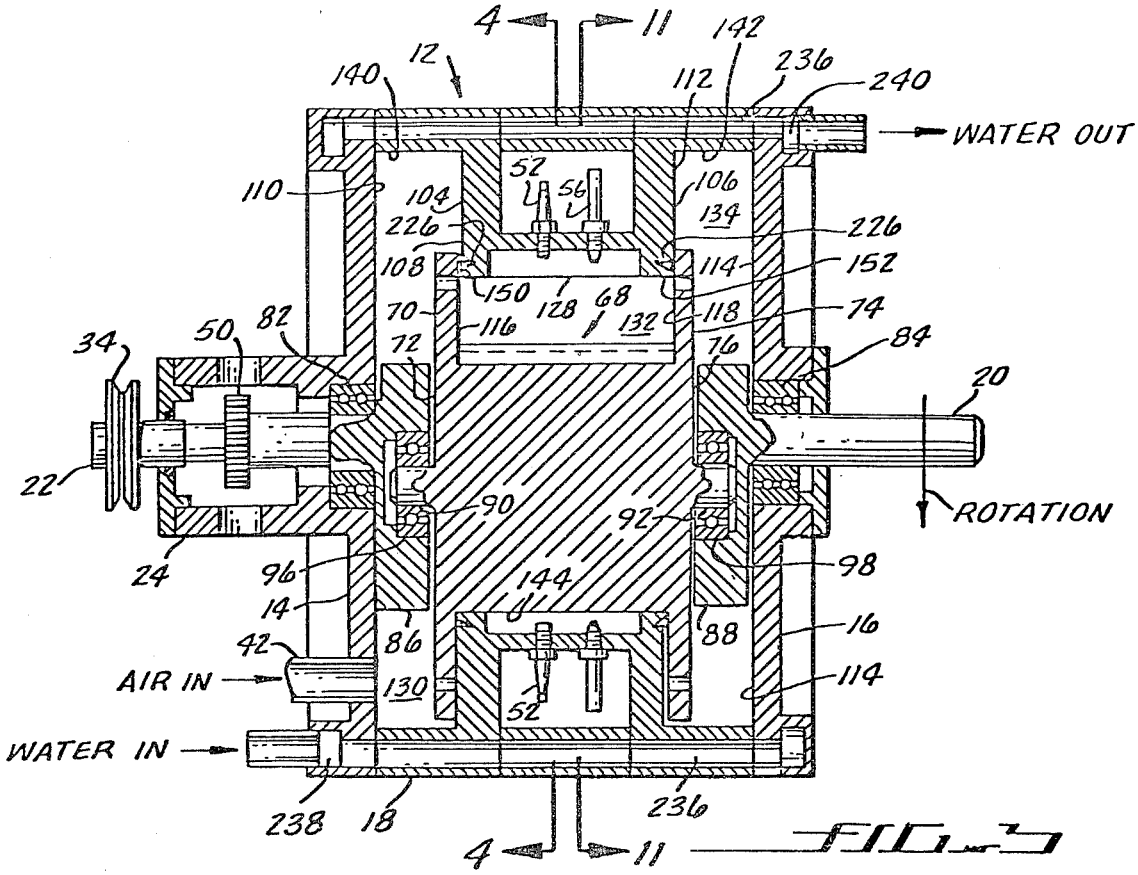
FIG. 3 is a sectional view of the engine along line 3—3 of FIG. 2, showing installation of the engine rotor.

More particularly and as best seen in FIGS. 2 and 3, the engine 10 includes a generally spool shaped rotor 68 having a first annular flange 70 projecting radially outwardly from a first rotor end 72 and a second annular flange 74 projecting radially outwardly from an opposite, second rotor end 76.

The accessory drive shaft portion 22 is journalled for rotation in the housing first end wall 14 by a bearing 82; the main drive shaft portion 20 is similarly journalled for rotation in the second end wall 16 by a bearing 84, both drive shaft portions being axially aligned with the axis of the housing 12. Eccentrically fixed to, or contiguous with, an inner end region of the accessory shaft portion 22 is a first rotor mounting disc 86. A similar second rotor mounting disc 88 is eccentrically fixed to, or contiguous with, an inner end region of the main drive shaft portion 20. Central aligned axes of the discs 86 and 88 are parallel to, but radially or laterally offset from, the common axis of the two shaft portions 20 and 22.

First and second cylindrical mounting portions 90 and 92, respectively, axially project from the first and second rotor ends 72 and 76, and are journalled for rotation on the axis of the first and second discs 86 and 88 by bearings 96 and 98. Such mounting of the end portions 90 and 92 in the discs 86 and 88 causes the longitudinal axis of the rotor 68, along which such end portions project, to be radially, or laterally displaced from the common axis of the shaft portions 20 and 22, thereby causing an eccentric movement of the rotor, upon rotation thereof, relative to the shaft portions, as more particularly described below.

Projecting radially inwardly to the housing 12 are a first annular wall member 104 and, axially spaced towards the second end wall 16 therefrom, a similar second annular wall member 106. The first annular wall member 104 has an axial outer transverse wall surface 108 which faces an axial inner surface 110 of the housing first end wall 14; the second annular wall member 106 has an axial outer transverse wall surface 112 which faces an axially inner surface 114 of the second end wall 16.

With the rotor 68 installed in the above described manner, relative spacing between the transverse wall surfaces 108 and 112 and the rotor flanges 70 and 74, as well as the radial outer diameter of the flanges and radial inner dimensions of the wall members 104 and 106, causes at least radially outer regions of inner transverse rotor flange surfaces 116 and 118 to be closely adjacent to the wall surfaces 108 and 112, respectively, for all orbital positions of the rotor.

Figure 4:
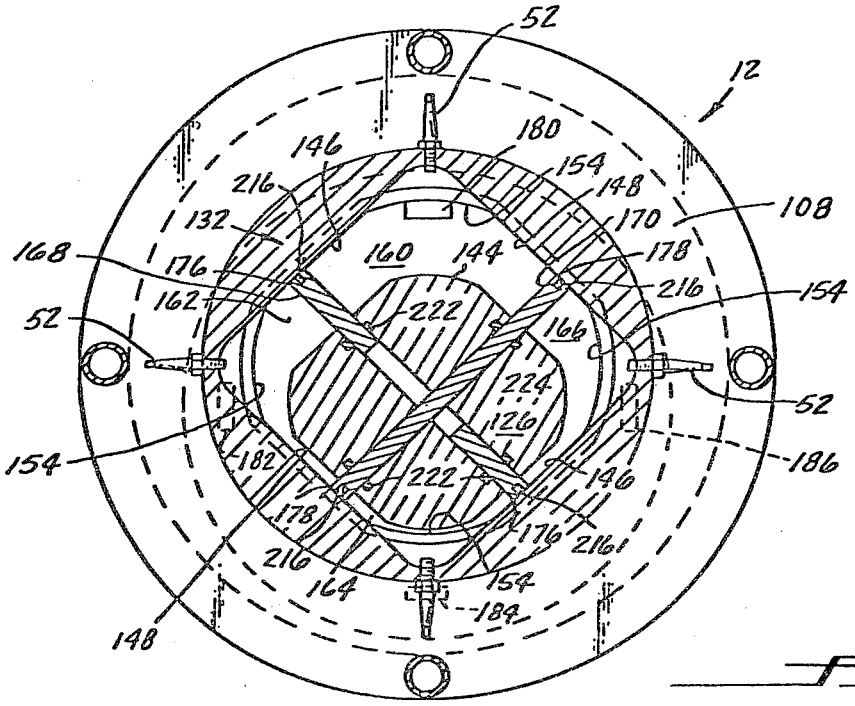
FIG. 4 is a transverse sectional view of the engine along line 4—4 of FIG. 3, showing features of the rotor and central chamber in which the rotor is installed.

As is seen in both FIGS. 3 and 4, a central portion 126 of the rotor 68 is substantially smaller in transverse cross section than that portion of the housing, defined by an inner circumferential wall 128, in which the rotor central portion is mounted.

In this manner, the inside of the housing 12 is divided into a disc shaped combustion air chamber or plenum 130 at the first housing end wall 14, an intermediate annular central chamber 132, and a disc shaped exhaust gas plenum or chamber 134 at the second housing end wall 16.

The combustion air chamber 130 is defined or bounded by the inner surface 110 of the first end wall 14, an inner circumferential housing inner wall portion 140, the transverse wall surface 108 and the rotor first end 70. In an analogous manner, the exhaust gas chamber 134 is bounded by the inner surface 114 of the housing second end wall 16, a housing circumferential inner wall portion 142, the transverse wall surface 112 and the rotor second end 76. Located between the two plenums 130 and 134, the central chamber 132 is defined by the transverse surfaces 116 and 118 of the rotor flanges 70 and 74, an outer surface 144 of the rotor portion 126 and the housing circumferential wall 128. The discs 86 and 88 are disposed in the plenums 130 and 134, respectively. The air supply line 42 communicates from the air blower 32 to the combustion air plenum 130 and the exhaust gas manifold 60 communicates through the side of the housing 12 to the exhaust gas plenum 134.

Referring to FIG. 4, the transverse cross section of the central chamber is seen to be generally square, being bounded on the outer periphery by a first pair of opposing planar walls or surfaces 146 and, orthogonal thereto, a second pair of opposing planar walls or surfaces 148. Inner peripheral edges or surfaces 150 and 152 (FIG. 3) of the annular wall members 104 and 106, respectively, are also generally square in outline, following the planar surfaces 146 and 148 for the most part, but have reduced corners 154 (shown only for the surface 150). The transverse cross section of the rotor portion 126 is also generally square with reduced or rounded off corners.

Figure 5A:
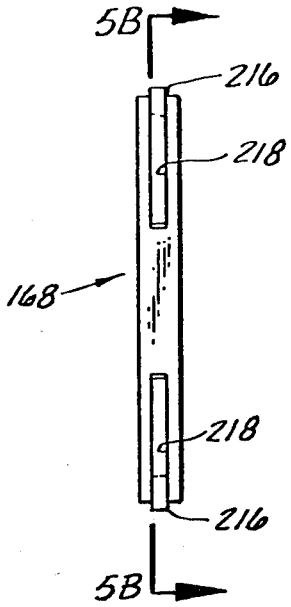
FIG. 5 is a drawing of one of the two rotor vanes, FIG. 5*a* being an end view of the vane and FIG. 5*b* being a cross sectional view along line 5*b*—5*b* of FIG. 5*a;*
Figure 5B:
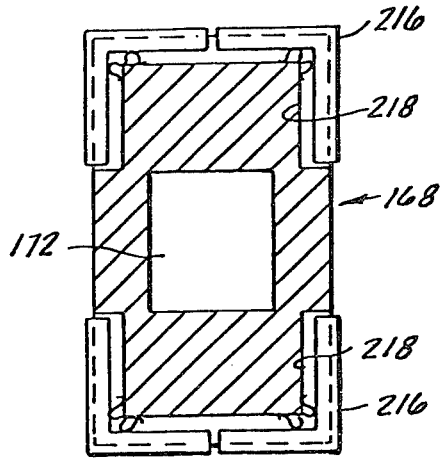
Figure 6A:
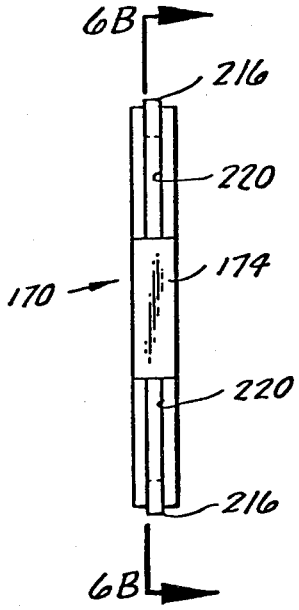
FIG. 6 is a drawing of the other rotor vane, FIG. 6*a* being an end view of the vane and FIG. 6*b* being a cross sectional view along line 6*b* —6*b* of FIG. 6*a;*
Figure 6B:
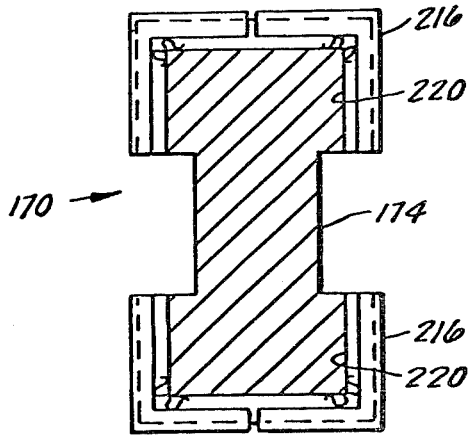
Figure 7:
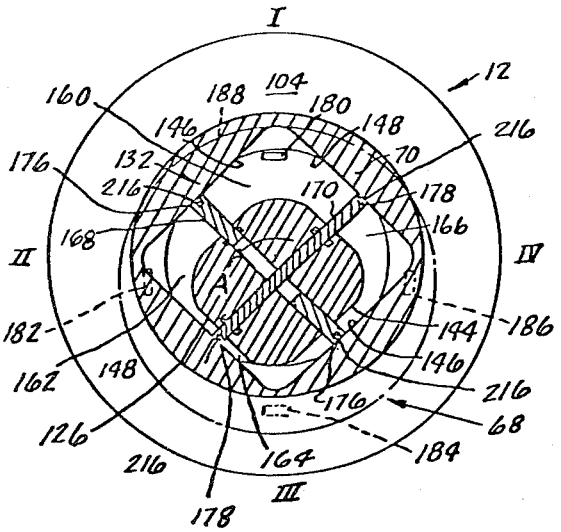
FIG. 7 is a transverse sectional view of the engine in the plane of FIG. 4, along line 4—4 of FIG. 3 showing the engine rotor in the 0° orbital position and showing the first combustion air port open to the first working chamber.

To divide the central chamber 132 circumferentially into four separate working or firing chambers, or combustion sub-chambers, 160, 162, 164 and 166 (FIG. 4), two elongated, generally rectangular rotor blades or vanes 168 and 170 are installed, in a mutually orthogonal relationship, diametrically through the rotor 68. As seen in FIG. 5, the first vane 168 is formed having an elongated rectangular central aperture 172; whereas, the second vane 170 is formed having a recessed or necked-down central region 174 (FIG. 6). Upon assembly into the rotor 68, which may accordingly be segmented (not shown), the second vane 170 is installed through the first vane aperture 172 so that the recessed region 174 is within the aperture. In this manner, after the two vanes 168 and 170 are installed in the rotor 68, each vane is free to slide through the rotor over a distance bounded by the length of the aperture 172 and the recessed region 174.

Lengths of the vanes 168 and 170 are substantially equal to the transverse spacing between the pairs of surfaces 146 or 148, such that outer ends 176 and 178 of the vanes 168 and 170, respectively, are always maintained closely adjacent to the corresponding surfaces 146 and 148. Widths of the vanes are substantially equal to the axial spacing between the rotor flange surfaces 116 and 118. As a consequence, the two vanes 168 and 170 both define and completely isolate the working chambers 160–166 from one another.

Four combustion air ports or openings 180, 182, 184 and 186 (FIGS. 7–10) are formed in the first rotor flange 70, at 90 degree intervals, near an outer circular edge 188 of such flange, each opening 180–186 being associated with a corresponding one of the working chambers 160–166, respectively, and communicating between the air plenum 130 and the corresponding working chambers 160–166 at preselected rotor orbital positions, as more fully described below. At other rotor. 68 orbital positions, because of transverse movement of the rotor flange 70 relative to the wall member 104, various of the ports 180–186 are covered or blocked by such wall member. Alternatively the air ports 180–186 could be formed in the first wall member 104.

Similarly, as seen in FIGS. 11–14, four exhaust gas ports 190, 192, 194 and 196 are formed through the rotor second flange 74, near an outer edge 198 thereof, in substantial axial alignment with the air ports 180–186, that is, the first exhaust port 190 is aligned with the first air port 180, and so forth, such that the exhaust ports open slightly before inlet ports to initiate purge by relatively high exhaust pressure. At the same preselected rotor orbital positions in which the air ports 180–186 communicate with corresponding ones of the working chambers 160–166, the exhaust gas ports 190–196 likewise communicate between the corresponding working chambers and the exhaust gas plenum 134 for exhausting combustion gases from the chambers. At other rotor positions, the exhaust gas ports are blocked by the second wall member 106, also as more particularly described below. Also, alternatively, the exhaust gas ports 190–196 could be formed in the second wall member 106.

Although the volume of each of the working chambers 160–166 is caused to vary in a sequential manner as the rotor 68 orbits about the central chamber 132, due to the eccentric mounting of the rotor relative to the shaft portions 20 and 22, the working chambers do not rotate about the central chamber. This is because the rotor 68 itself does not rotate about the chamber and is prevented from so doing by an anti-rotation bellcrank 200 (FIG. 2) which has a first axial projecting portion 202 received in an aperture 204 formed in the first housing wall 14 and a laterally offset, oppositely projecting portion 206 received in an aperture (not shown) in the rotor first flange 72. The bellcrank 200 permits some small amount of rotational movement of the rotor 68 relative to the housing 12, as is necessary for rotor operation, but constrains the rotor to orbital movement.

Since the working chambers 160–166 remain fixed in position relative to the housing 12, the four spark plugs 52 and four fuel injection nozzles 56 are installed through the housing in fixed positions with one of the spark plugs and one of the nozzles in communication with each of the working chambers. Preferably the spark plugs 52 and nozzles 56 are installed at corners of the central chamber 132 which correspond to the working chambers. Injection of fuel through the nozzles 56 and into the working chambers 160–166, and ignition of resultant fuel-air mixture in the working chambers, occurs at preselected rotor orbital positons, as described below.

Isolation of the working chambers 160–166, that is, high pressure gas sealing of such chambers leakage between the working chamber and to other interior portions of the housing 12, is provided by expansion-type or spring loaded vane seals 216 installed in edge grooves or recesses 218 and 220 of the first and second vanes 168 and 170, respectively (FIGS. 5 and 6). These seals 216, more than one of which may be used in each vane, are generally similar to conventional piston rings used in reciprocating-type internal combustion engines.

Also, spring loaded seals 222 (FIG. 4) are installed in axial grooves 224 formed in the rotor portion 126 on each side of the vanes 168 and 170; the seals 222 preventing gas leakage radially along the vanes. A third set of seals 226, in ring form, is installed in the wall members 104 and 106 in regions of contact with the rotor flange inner surfaces 116 and 118, respectively.

At maximum compression of each of the working chambers 160–166, the chambers are generally triangular in transverse cross section, being bounded by the substantially square corners of the chamber 132 and adjacent curved surface portions of the rotor outer surface 144.

As best seen in FIG. 3, the engine 10 is liquid (water) cooled in a generally conventional manner. The housing 12 being constructed in hollow wall form with axial, labyrinth-type water flow passageways 236 connected between a water inlet manifold 238 and a water outlet manifold 240. Water or other cooling liquid is circulated through the engine by a water pump (not shown). Alternatively, the engine 10 may be air cooled, in which case the housing 12 may be formed with a number of cooling fins (not shown) or a hybrid liquid/air cooling system, combining water passages and cooling fins, may be employed.

OPERATION OF THE ENGINE 10

Operation of the engine 10 is generally apparent from the foregoing description and from an examination of FIGS. 7–10, which illustrate sequential opening and closing of the air ports 180–186, and FIGS. 11–14, which illustrate sequential opening and closing of the corresponding exhaust ports 190–196.

At zero degree rotor position (FIG. 7), the air port 180 associated with the first working chamber 160 is open thereinto, that is, the port 180 is not covered or blocked by any portion of the wall member 104. However, the remaining three air ports 182–186 associated with the chambers 162–166, are out of registration with such chambers, being blocked or cornered by the wall member 104 due to the eccentric mounting and orbital movement of the rotor 68. At this zero degree rotor position, the first working chamber 160 is at maximum expansion; whereas, the opposing third working chamber 164 is at a minimum volume (maximum compression). The second and fourth chambers 162 and 166 are at intermediate stages of compression or of expansion. Assuming orbiting of the rotor 68 in the direction of arrow A, the chambers 166 and 160 will next be compressed by further orbital movement of the rotor; whereas, the chambers 162 and 164 will be expanded.

Air is forced by the blower 32 from the air plenum 130 through the port 180 and into the first working chamber 160. No combustion air can, however, enter the remaining three working chambers 162–166 because the air ports 182–186 are blocked by the wall member 104.

At this same initial zero degree rotor position, the exhaust gas port 190 is also open to the first working chamber 160 (FIG. 11), the remaining three exhaust gas ports 192–196 being blocked by the wall member 106. Since the exhaust gas port 190 is open, combustion air pumped into the first working chamber 160 through the air port 180 sweeps combustion products or exhaust gases from such chamber through the port 190, through the exhaust gas plenum 134 and out the exhaust manifold 60. The chamber 160 is then filled with fresh combustion air.

Figure 8:
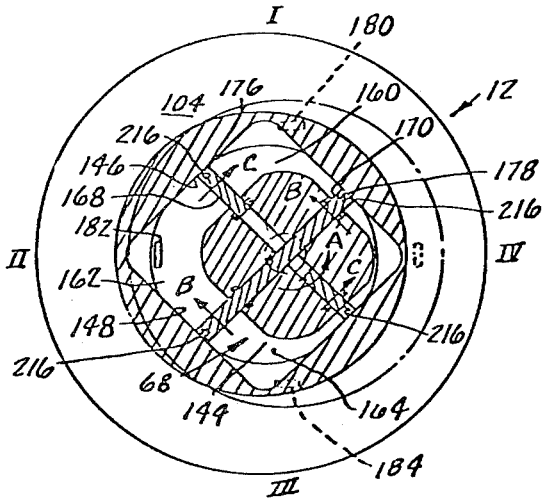
FIG. 8 is a transverse sectional view of the engine in the plane of FIG. 7, showing the engine rotor in the 90° orbital position, and showing the second combustion air port open to the second working chamber.
Figure 12:
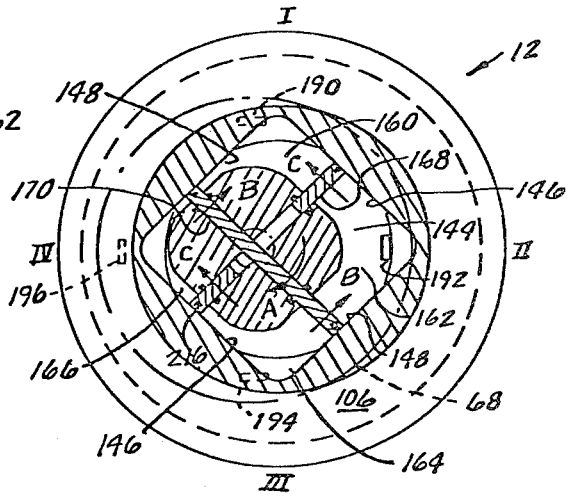
FIG. 12 is a transverse sectional view of the engine in the plane of FIG. 11, showing the engine rotor in the 90° orbital position and showing the second exhaust gas port open to the second working chamber.

As the rotor 68 orbits in the direction of arrow A to the 90 degree orbital position shown in FIGS. 8 and 12, the rotor vane 170 moves obliquely with the air port 180 in the direction of arrow B; the vane 168 moves obliquely with such port in the direction of arrow C. Orbital movement of the rotor 68 moves the air port 180 upwardly relative to the wall member 104 to the extent that the port becomes blocked or closed off and out of registration with the working chamber 160.

Also by the described orbital movement of the rotor 68, volume in the first working chamber 160 is decreased while the volume of the fourth working chamber 166 is fuly compressed to a minimum. At the same time, volume of the third chamber 164 is being expanded, while the second chamber 162 is being fully expanded with the corresponding air port 182 now opened for admitting air thereinto. As seen in FIG. 12, the exhaust gas port 196 is likewise now opened into communication with the second working chamber 162 so that introduction of combustion air into the chamber purges the chamber of exhaust gases.

Orbital driving force for the rotor 68 is provided by expansion of combustion gases from air routed fuel-air mixture in the working chambers 162 and 164 (assuming prior injection of fuel into these chambers, through the fuel injection nozzles 56 during compression of the chamber and subsequent ignition of the resulting fuel-air mixture in the chambers by the spark plugs 52) at appropriate compression stages. The high pressure combustion gases, acting on adjacent surfaces of the vanes 168 and 170, as well as on the rotor surface 144, drive the rotor in the direction of arrow A, causing orbiting of the rotor in the central chamber 132 and consequent rotation of the shaft portions 20 and 22 to which the rotor is mounted. This orbital movement of the rotor 68 also causes the above described compression of the working chambers 166 and 160 which are later fired in that sequence.

It is to be appreciated that as a result of the square cross section of the central chamber 132, because the vanes 168 and 170 are substantially as long as spacing between opposite pairs of walls 146 and 148, and because of mounting of the rotor 68 with the vanes orthogonal to the corresponding wall pairs, the inner ends 176 and 178, that is the seals 216 in such ends, always slide tangentially along the wall pairs. There is thus always a completely tangential sliding action between the vane seals 216 and the wall pairs 146 and 148. This is in contrast with heretofore disclosed or available orbital engines in which the angles between the vanes and adjacent inner walls of the housing defining the working chambers continuously change as the rotor orbits, and the seals do not make a constant angle with the walls, sealing between the vanes 168 and 170 and the wall pairs 146 and 148 is thus easily, inexpensively, and effectively accomplished; whereas, sealing between the vanes and inner housing walls on previously disclosed orbital engines is difficult and relatively ineffective.

Figure 9:
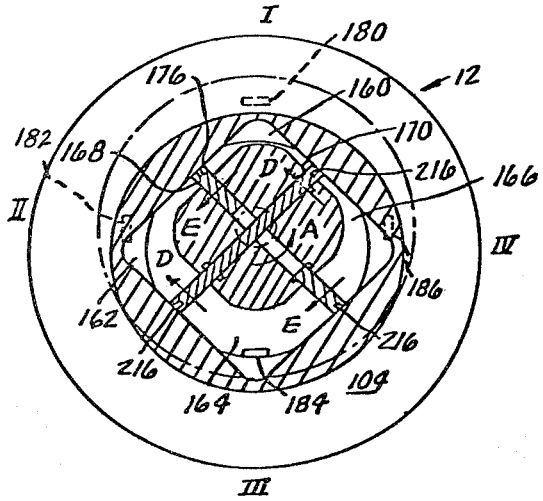
FIG. 9 is a transverse sectional view of the engine in the plane of FIG. 7, showing the engine rotor in the 180° orbital position and showing the third combustion air port open to the third working chamber.
Figure 13:
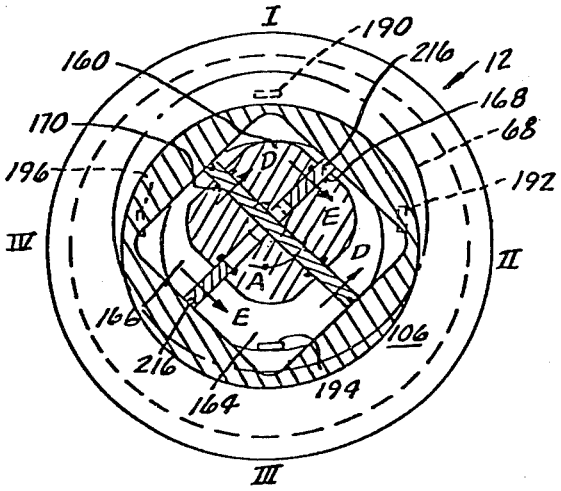
FIG. 13 is a transverse sectional view of the engine in the plane of FIG. 11, showing the engine rotor in the 180° orbital position and showing the third exhaust gas port open to the third working chamber.

The rotor 68 is shown orbited or rotated to a 180 degree position in FIGS. 9 and 13, the vane 170 being moved obliquely with both the air port 180 and the exhaust gas port 190 (direction of arrow D) and the vane 168 being moved obliquely with such ports (direction of arrows E). At this 180 degree rotor orbital position, the first working chamber 160 is fully compressed, the third firing chamber 164 is fully expanded, the second working chamber 162 is partially compressed from the fully expanded configuration and the fourth working chamber 166 is partially expanded from the fully compressed configuration.

Also in this 180 degree rotor position the air and exhaust gas ports 184 and 194, respectively, are uncovered by the wall members 104 and 106 and are therefore open into the third working chamber 164. The other air ports 180, 182 and 186 and exhaust gas ports 190, 192 and 196 are closed off by the wall members 104 and 106. Fuel previously injected into the chambers 164 and 166 (by corresponding fuel nozzles 56) has been mixed with air therein and ignited (by corresponding spark plugs 52) to generate high pressure combustion gases to continue driving the rotor 68.

Figure 10:
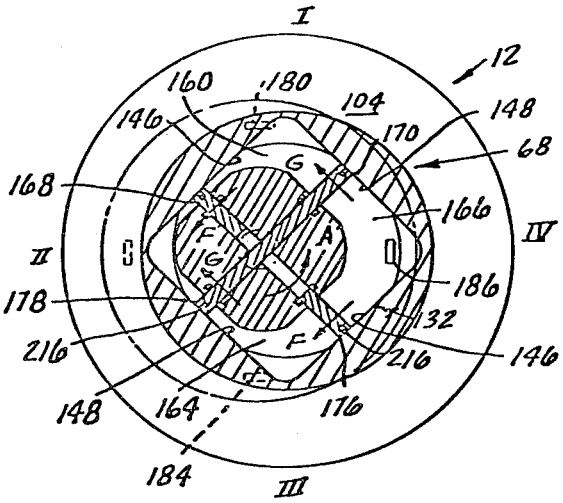
FIG. 10 is a transverse sectional view of the engine in the plane of FIG. 7, showing the engine rotor in the 270° orbital position and showing the fourth combustion air port open to the fourth working chamber.
Figure 11:
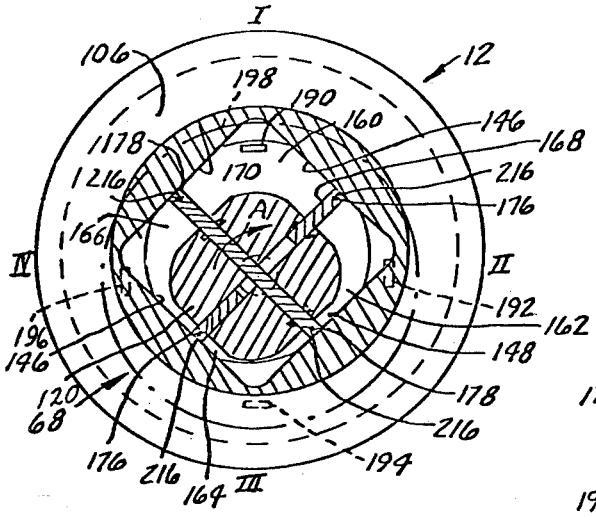
FIG. 11 is a transverse sectional view of the engine along the line 11—11 of FIG. 3, looking in the direction opposite to that of FIG. 7, showing the engine rotor in the 0° orbital position and showing the first exhaust gas port open to the first working chamber.
Figure 14:
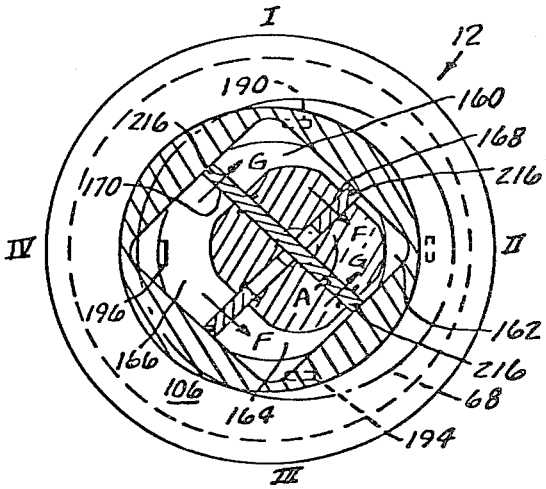
FIG. 14 is a transverse sectional view of the engine in the plane of FIG. 11, showing the engine rotor in the 270° orbital position and showing the fourth exhaust port open to the fourth working chamber.

FIGS. 10 and 14 illustrate continued orbiting of the rotor 68 to 270 degree position in which the second working chamber 162 is fully compressed and the fourth working chamber 166 is fully expanded. The first working chamber 160 is undergoing expansion and the third working chamber 164 is undergoing compression. Both the air port 186 and exhaust gas port 196 into the working chamber 166 are open; whereas, the remaining air ports 180, 184 and 186 and exhaust gas ports 190, 194 and 196 are blocked by portions of the wall members 104 and 106. Movement of the vanes 168 and 170 are in the direction of arrows F and G, respectively.

From the FIGS. 7–14, it is apparent that while movement of the rotor 68 is orbital in nature, movement of the vanes 168 and 170 is actually reciprocating in nature, the vane 168 sliding back and forth along the pair of walls 146 and the vane 170 sliding back and forth along the pair of walls 148. As the vanes 168 and 170 reciprocate, they also slide back and forth in the rotor 68. Because each of the vanes 168 and 170 projects entirely through the rotor 68 to project radially outwardly from opposite sides and because the vane length is equal to the spacing between the pairs of walls 146 and 148, no springs or other urging means are required to force the vanes outwardly into contact with the chamber walls. Thus, sealing and construction of the engine 10 is simplified and made less expensive, maintenance is made easier and engine reliability and service life are greatly increased.

It is seen from FIGS. 7–14 that rotor orbital movement causes the air ports 180–186 and the exhaust gas ports 190–196 in the rotor flanges 70 and 74 to be exposed and covered up sequentially as the flanges move transversely relative to the wall members 104 and 106. This provides simple, inexpensive, yet effective and reliable valving of combustion air to, and exhaust gases from, the corresponding working chambers 160–166 with a minimum of moving parts.

Figure 15:
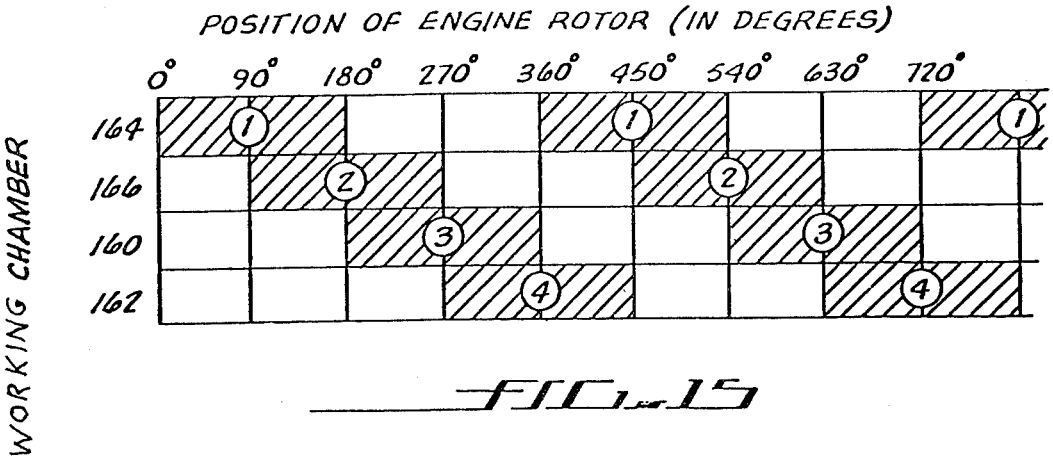
FIG. 15 is a diagram showing the firing order of the four working chambers and the 90° power overlap between the working chambers.

FIG. 15 which shows the firing order (164, 166, 160, 162) of the working chambers 160–166 also shows when each such chamber fires relative to rotor position. It is seen that each of the four chambers 160–166 fires once during each 360 degree orbital movement of the rotor 68 and that the power stroke of each firing lasts for about 180 degrees of rotor movement. Thus, a 90 degree power overlap exists between adjacent working chambers, thereby assuring smooth, continuous engine operation.

Fuel is typically injected into the working chambers 160–166 just shorly after the associated combustion air and exhaust gas ports are completely blocked by the wall members 104 and 106. The distributor 48 may be adjusted to cause the spark plugs 52 to ignite the resulting fuel-air mixture in the working chambers 160–166 at orbited positions of the rotor 68 preselected according to engine speed, in a manner similar to that employed in reciprocating piston internal combustion engines. As an illustration, at low engine RPM (for example, about 500) the fuel-air mixture may be ignited when the rotor 68 is positioned about 5° ahead of maximum working chamber compression; at high engine RPM (for example, about 3000) the mixture is ignited about 20° before maximum working chamber compression.

As an example of engine performance, assuming a housing length and outside diameter of about 12 inches and a total working chamber displacement of about 67 cubic inches, using conventional gasoline fuel and combustion air at about 5 psi and 150 cubic feet per minute, approximately 78 brake horsepower is expected. Further assuming engine weight including accessories, flywheel and housing to be about 195 pounds, a weight to brake horsepower ratio of about 2.5 is expected. This compared to the typical range of 4.5–10 pounds/brake horsepower ratio of conventional reciprocating piston internal combustion engines.

Although the engine 10 has been described and illustrated as having four working chambers 160–166, making the engine generally correspond to a conventional four cylinder engine, by changing the cross sectional configuration of the combustion chamber and employing more than two rotor vanes, more than four working chambers can be provided. For example, the transverse cross section of the combustion chamber may be made hexagonal in shape, having three opposing, parallel pairs of walls. In such case, three rotor vanes, arranged in the rotor at 60 degree intervals could be used, each vane interacting the other two and extending downwardly through the rotor. It is to be appreciated that the vanes would be configured so that each vane could slide in the rotor independently of the others, as can the two vanes 168 and 170. Additional combustion air ports and exhaust gas ports would be provided, one air and one exhaust gas port being associated with each working chamber. A spark plug 52 and fuel injection nozzle 56 would also be provided for each working chamber.

As described and illustrated, combustion of a fuel-air mixture in the working chambers 160–166 cause high pressure combustion gases which, by acting on the vanes 168 and 170 and on the rotor 68 drive the rotor in an orbital path about the central chamber 132. Movement of the rotor 68 is constrained to this orbital path by the anti-rotation bell crank 200. This orbital movement of the rotor 68 in turn causes rotation of the drive shaft portions 20 and 22, the portion 22 causing operation of the blower 32, distributor 48. Power is taken off the drive shaft portion 20.

It is apparent to one skilled in the art that with only minor changes, the engine 10 can be operated as a fluid pump, compressor, vacuum pump or expander or hydraulic motor. In such applications, except expander and hydraulic motor which develop power; power is applied to, rather than taken from, the shaft portion 20 in order to drive the rotor in orbital motion. In general, the changes need be made only to the combustion air and exhaust gas ports so that the air ports may function as (or be replaced by) inlet ports and the exhaust gas ports may function as (or be replaced by) outlet ports. As illustrative manner in which such modification may be accomplished, follows.

VARIATION OF FIGS. 16–27

An air compressor, a fluid pump or the like apparatus 300 is shown generally in FIGS. 16–27. In these figures parts and features identical to those previously illustrated and described for the engine 10 are given the same reference numbers; parts and features corresponding and similar to those previously described and illustrated are given the original reference numbers followed by the letter (a); new parts and features given new reference numbers.

A princpal difference between the above described engine and the apparatus 300 is in the arrangement of ports which admit gas or fluids into that portion previously identified as the central chamber 132 and which is utilized as a pumping or compression chamber in the pump 300, and of the ports discharging gas or fluids from such portion, and in the sequence and manner of covering and uncovering the ports as necessary for proper operation.

Figure 16:
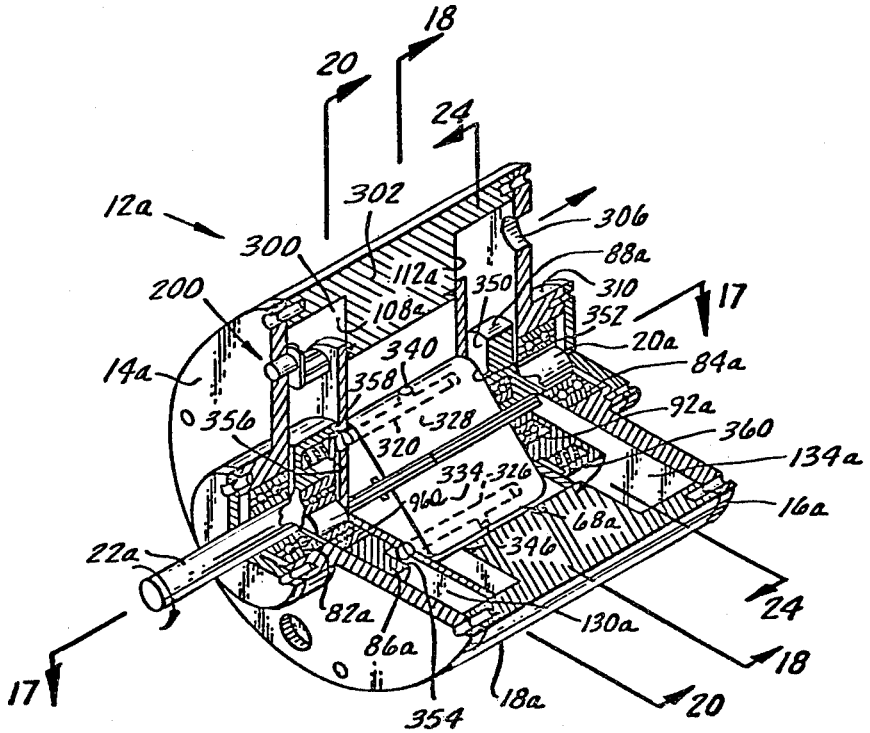
FIG. 16 is a cutaway perspective drawing of a fluid pump incorporating features of the orbital engines.
Figure 17:
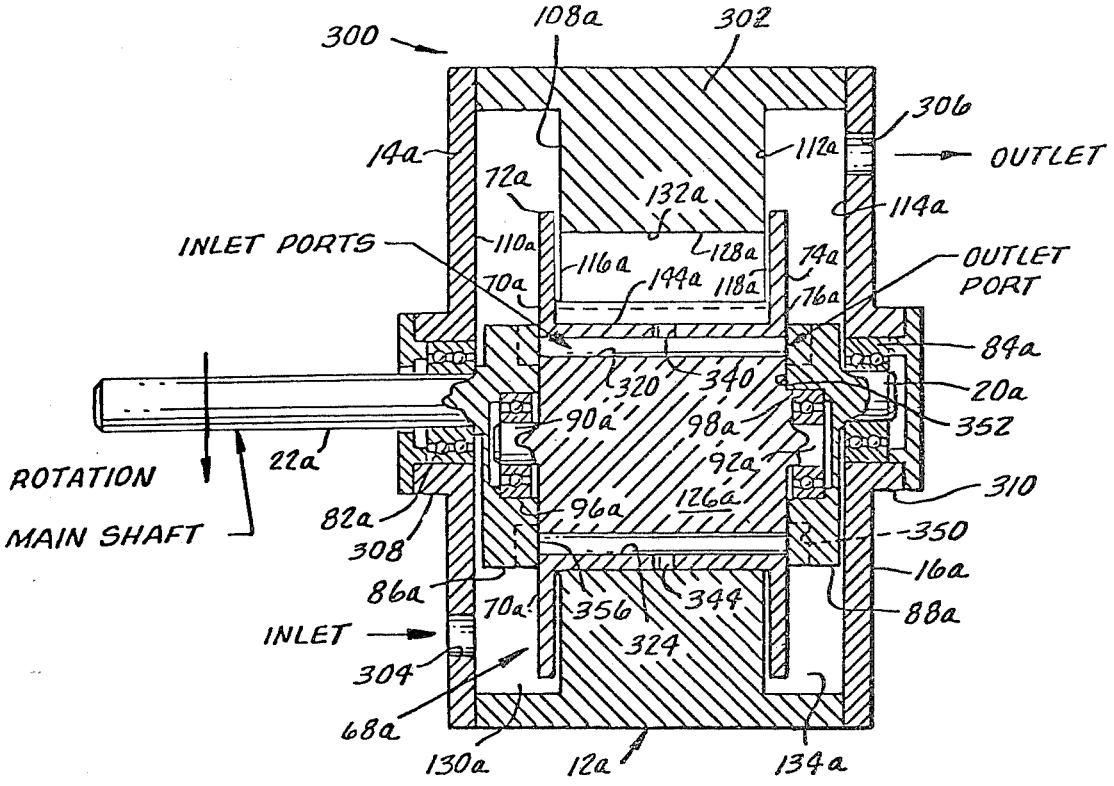
FIG. 17 is a sectional view of the pump along line 17—17 of FIG. 16, showing the features of the pump.

FIGS. 16 and 17 illustrate a housing 12*a* for a pump, compressor or the like which is generally similar to the previously described engine housing 12, having a first end wall 14*a*, a second end wall 15*a* and a circumferential wall portion 18*a* therebetween. As shown, instead of the two annular wall members 104 and 106, a wide, central annular wall member 302 is provided, the axial width or thickness of such wall member being substantially the axial length of a central portion 126*a* of a rotor 68*a*. The annular wall member 302 has a first transverse surface or side 108*a* which faces an inner surface 110*a* of the first end wall 14*a* and a second transverse surface or side 112*a* which faces an inner surface 114*a* of the second end wall 16*a*. A rotor 68*a*, similar to the previously described rotor 68, has a first flange 70*a* at a first end 72*a* and a second flange 74 at a second end 76*a*.

An inlet plenum 130*a*, similar to the combustion air plenum 130, is defined between the opposing surfaces 110*a* and 108*a* and the first rotor end 72*a* and an outlet plenum 134*a*, similar to the exhaust gas plenum 134, is defined between the opposing surfaces 114*a* and 112*a* and the second rotor end 76*a*. An annular pumping or compressing chamber section 132*a* is defined by transverse surfaces 116*a* and 118*a* of the rotor flanges 70 and 74*a* and by an inner surface 128*a* of the housing and an outer surface 144 of the rotor. The chamber 132*a* is generally similar to the working chamber 132 described above, except that corners of the chamber 132*a* are reduced so that such diameter is, in cross section, more nearly circular with flatened side portions. An inlet opening 304 is provided through the first end wall 14*a* to the inlet plenum 130*a* and an outlet opening 306 is provided through the second end wall 16*a*.

A main shaft portion 22*a* is journalled for axial rotation along the axis of the housing 12*a* in a bearing 82*a* which is installed in an outwardly projecting boss 308 formed in the first housing end wall 14*a*. Similarly a stub shaft portion 20*a* is journalled for rotation in a bearing 84*a* installed in an outwardly projecting boss 310 formed in the second housing end wall 16*a*. The rotor 68*a* is rotatably connected to the shaft portions 20*a* and 22*a* by having axially projecting cylindrical first and second end projections 90*a* and 92*a* received respectively in bearings 96*a* and 98*a* installed in members 86*a* and 88*a* fixed to inner ends of the shaft portions 22*a* and 20*a*. Mounting of the rotor 68*a* is with the rotational axis of the rotor laterally or radially offset from the common axis of the shaft portions 20*a* and 22*a*.

The rotor 68*a* is provided with first and second rotor vanes 168 and 170 (FIG. 18) having seals 216 which slide tangentially along parallel inner housing surfaces 146 and 148. The vanes 148 and 170, which are mutually orthogonal, are radially mounted to slide through the rotor 68*a* and are sealed by side seals 222. Four pumping or compression sub-chambers 160*a*, 162*a*, 164*a* and 166*a* (corresponding to the engine working chambers 160, 162, 164 and 166) are formed by the vanes 168 and 170 within the chamber 132*a*. The antirotation bell crank 200 constrains the rotor 68*a* to orbital movement as above described for the engine 10.

Figure 18:
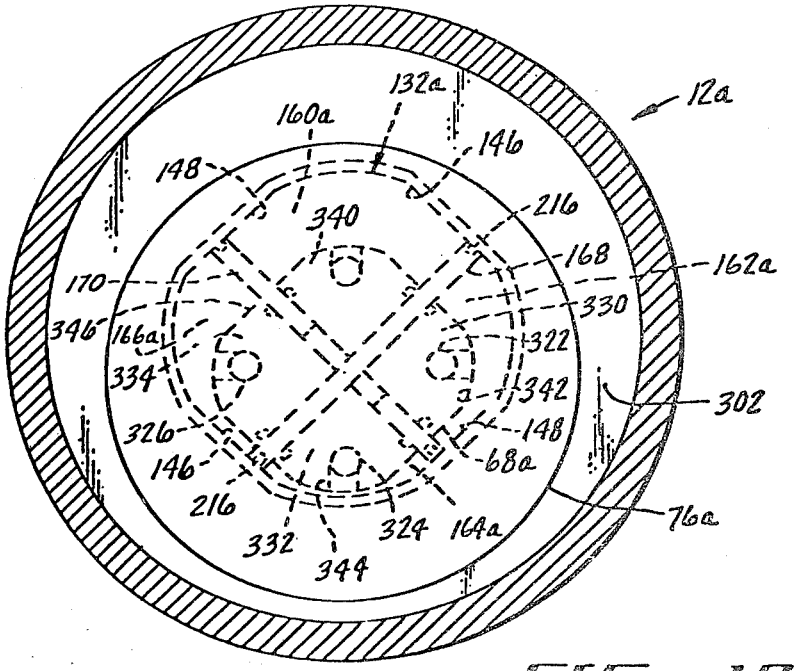
FIG. 18 is a transverse sectional view along line 20—20 of FIG. 16, showing internal features of the pump.

Fluid or gases are admitted to, and removed from, the four subchambers 160*a*–168*a* through four equally spaced passageways or openings 320, 322, 324 and 326 bored axially through the rotor 68*a* (FIG. 18). The first opening 320 is in a first rotor quadrant 328 adjacent to the first subchamber 160*a*, the second opening 322 is in a second rotor quadrant 330 adjacent to the second subchamber 162*a* and the third and fourth openings 324 and 326 are in third and fourth rotor quadrants 332 and 334 adjacent the third and fourth subchambers 164*a* and 166*a* respectively. Short radial openings or passages 340, 342, 344 and 346 in the rotor quadrants 328, 330, 332 and 334 connect the openings 320, 322, 324 and 326 to the subchambers 160*a*, 162*a*, 164*a* and 166*a*, respectively.

Flow of fluid or gases into and ot of the subchambers 160*a*–166*a*, through the openings 320–326 and 340–346, is controlled by the two shaft members 86*a* and 88*a* to which the rotor 68*a* is rotatably connected, and which rotate relative to the rotor as the rotor orbits around the chambers 132*a*. The members 86*a* and 88*a* are configured to admit fluid or gases into and out of the subchambers 160*a*–166*a* at preselected rotor orbital positions, the members being differently configured depending upon whether a fluid is to be pumped or a gas is to be compressed, etc.

FIG. 19 illustrates a configuration of the members 86*a* and 88*a* which has been found useful for pumping liquids when the apparatus 300 is used as a pump or by introducing the liquid at high pressure and discharging at low pressure apparatus 300 is used as a hydraulic motor. As seen, the member 88*a*, which is generally disc-like in shape, has an approximate semi-annular groove or recess 350 (of slightly less—for example about 2°–5°—than 180°) formed into an interior transverse surface 352 which, upon assembly, is adjacent to the second rotor end 76*a*. The recess 350, which surrounds half of the rotor bearing 92*a*, is radially centered at the same radius as the axial rotor openings 320–326. Thus as the rotor 68*a* orbits relative to the member 88*a*, outlet ends of the openings 320–326 will be closed part of the time by the surface 352 and will be open into the outlet plenum 134*a* part of the time through and along the recess 350 (FIGS. 16 and 17), thereby discharging fluid from the subchambers 160*a*–166*a* into the outlet plenum.

A similar semi-annular groove or recess 354 is formed into an opposing, transverse interior surface 356 of the other member 86*a* (FIGS. 16, 17 and 19). During part of a revolution of the rotor 68*a* relative to the member 86*a*, inlet ends of the openings 320–326 will be closed by the surface 356, during other parts of rotor rotation, the inlet ends will open into and through the recess 354 to admit fluid from the inlet plenum 130*a* into the subchambers 160*a*–166*a*.

As seen in FIG. 19, upon assembly, the members 86*a* and 88*a* are oriented so that the respective recess 350 and 354 are completely out of alignment and no portions thereof overlap.

FIGS. 20–23 illustrate opening and closing of inlet ends of the rotor openings 320–326 by the member 86*a* or 0°, 90°, 180° and 270° rotor orbital positions, respectively and are generally analagous to the previously described FIGS. 7–10 for the engine 10 (except for the direction the views are taken). FIGS. 24–27 illustrate opening and closing of outlet ends of the rotor openings 320–326 by the member 88*a* for the same 0°, 90°, 180° and 270° rotor orbital positions, and are generally analagous to the previously described FIGS. 11–14 for the engine 10 (except for the direction the views are taken).

Figure 20:
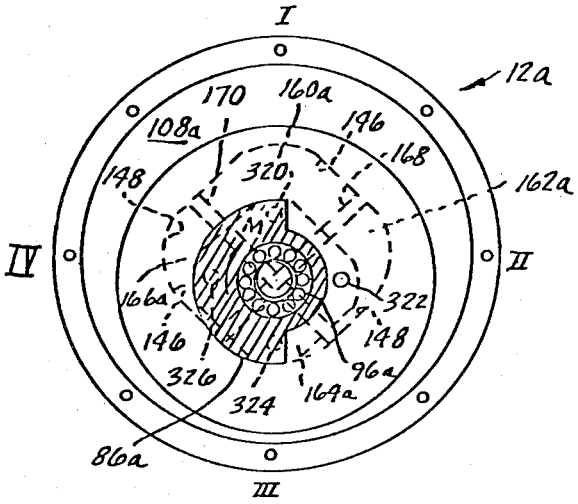
FIG. 20 is a transverse sectional view along line 20—20 of FIG. 16, showing the rotor in the 0° orbital position and showing inlet ends of rotor openings.
Figure 21:
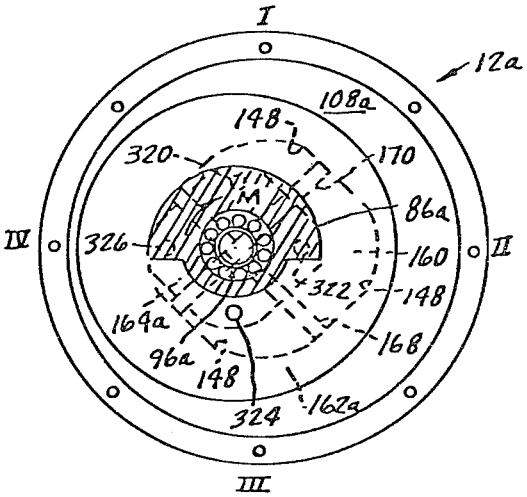
FIG. 21 is a transverse sectional view in the plane of FIG. 20, showing the rotor in the 90° orbital position.
Figure 22:
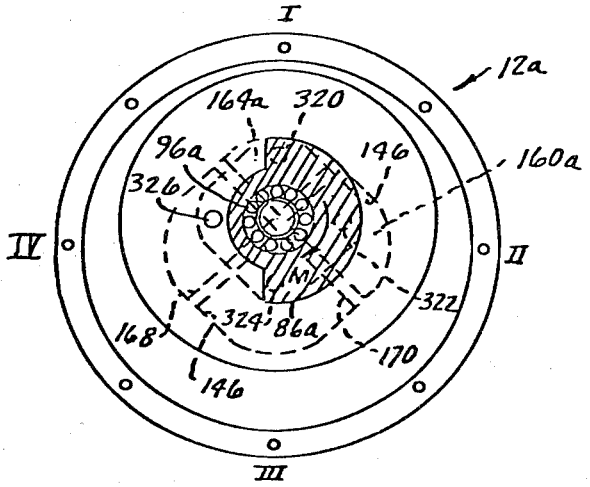
FIG. 22 is a transverse sectional view in the plane of FIG. 20, showing the rotor in the 180° orbital position.
Figure 23:
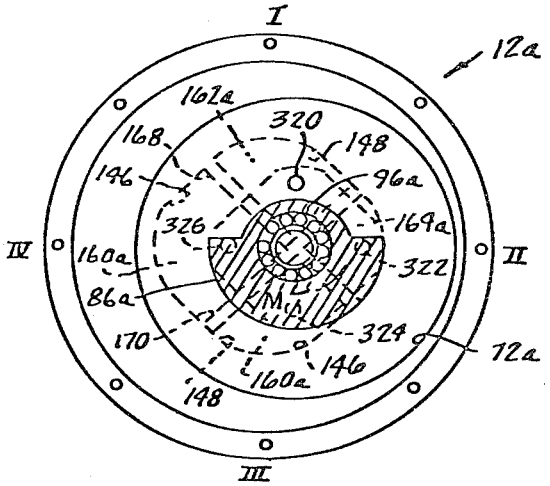
FIG. 23 is a transverse sectional view in the plane of FIG. 20, showing the rotor in the 270° orbital position.
Figure 24:
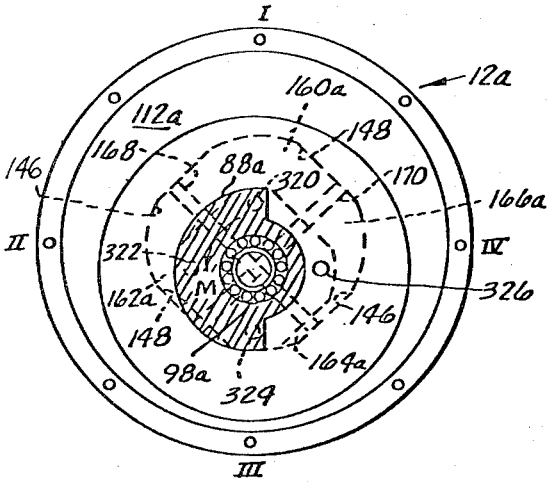
FIG. 24 is a transverse sectional view along the line 24—24 of FIG. 16, showing the rotor in the 0° orbital position and showing outlet ends of the rotor openings.
Figure 25:
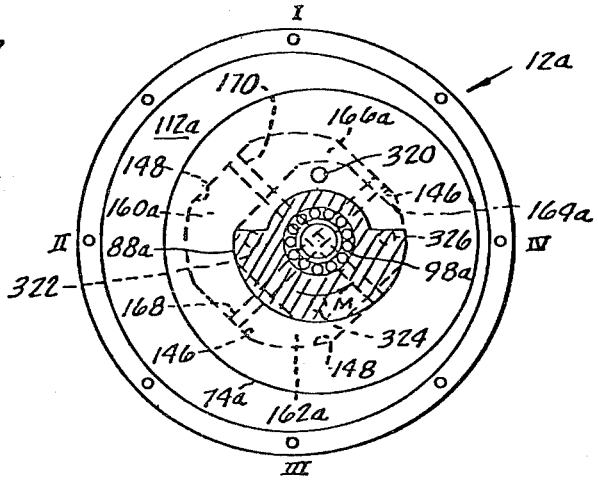
FIG. 25 is a transverse sectional view in the plane of FIG. 24, showing the rotor in the 90° orbital position.
Figure 26:
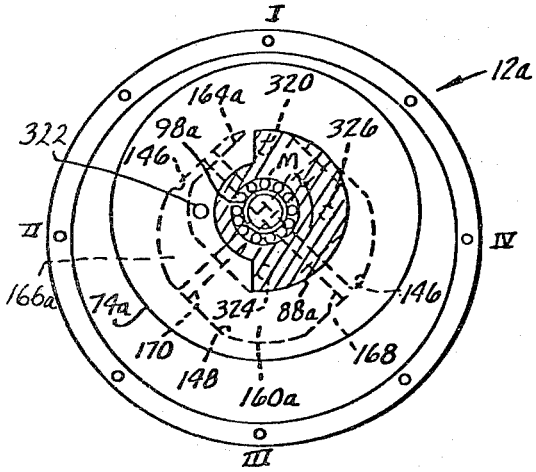
FIG. 26 is a transverse sectional view in the plane of FIG. 24, showing the rotor in the 180° orbital position.
Figure 27:
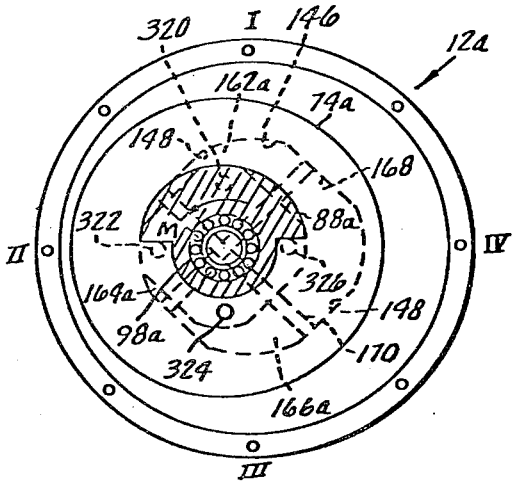
FIG. 27 is a transverse sectional view in the plane of FIG. 24, showing the rotor in the 270° orbital position.

In FIGS. 20 and 24 it is seen that inlet ends of the openings 320, 324 and 326 are closed while the inlet end of opening 322 is open whereas, outlet ends of the openings 320, 322 and 324 are closed while the outlet end of opening 326 is open. The rotor 68*a* is being orbited by the drive shaft portion 22*a* in the direction of arrow M. At the 90° rotor position (FIGS. 21 and 25) inlet ends of the openings 320, 322 and 326 are closed while that of opening 324 is open whereas outlet ends of openings 322, 324, and 326 are closed and 320 is open.

In the 180° rotor position (FIGS. 22 and 26) inlet ends of the openings 320, 322 and 324 are closed and 326 is open while outlet ends of openings 320, 324, and 326 are closed and 322 is open. Inlet ends of openings 320, 324, and 326 are closed and 320 is open, while outlet ends of openings 320, 322 and 326 are closed and 324 is open in the 270° rotor position depicted in FIGS. 23 and 27.

As the rotor 68*a* orbits about the chamber 132*a* volume of the subchambers 160*a*–166*a* is changed from maximum to minimum to provide a pumping action or shaft horsepower when apparatus 300 is used as a hydraulic motor. As subchamber volume is increased, fluid is drawn into the subchamber from the inlet plenum 130*a*. Fluid is then pumped out or expelled into the outlet plenum 134*a* as the volume of the subchamber is decreased. Such pumping operation is substantially the reverse of operation of the engine 10.

As seen in FIG. 16, an arcuate, spring loaded seal 358 may be provided in the face 356 of the member 86*a* and a similar seal 360 may be provided in the face 352 of the member 88*a*, such seals sealing closed inlet and outlet ends of the rotor openings 320–326. The various seals described above for use in the engine 10 may or may not be used in the apparatus 300, according to the pressures and application concerned.

It is to be appreciated that by varying the arc length of one or both of the recesses 350 and 354, for example, by making one or both recesses shorter than the 180 degrees shown, and by varying the relative position of the recesses, a variety of fluid pumping and compressing operations can be performed. As an example, FIG. 28 illustrates various alternative means for blocking and unblocking the rotor openings 320–326, thereby adapting the pump apparatus 300 for different applications. The segments shown in FIGS. 28*a–c* representing faces of the members 86*a* and 88*a*.

FIG. 28*a*, an arcuate inlet segment 370 which is approximately 180° long or approximately semi-annular, represents axially projecting face portions of the member 86*a*, which is not shown. An arcuate outlet segment 372, which is approximately 330° long represents axially projecting face portions of the member 88*a* (not shown). As can be seen, there is approximately a 150° overlap of the two segments 370 and 372. The configuration of the segments 370 and 372 has been found particularly useful for using the pumping apparatus as a gas compressor.

FIG. 28*b* illustrates a corresponding arcuate inlet segment 374 which is approximately 320° long and a corresponding arcuate outlet segment 376 which is approximately 180° long. Phasing of the two segments 374 and 376 is such that the segments 374 overlaps the segment 376 for approximately 140°, as can be seen. Configuration of the segments 374 and 376 is particularly adapted for using the pumping apparatus as a gas expander.

Similarly, FIG. 28*c* illustrates a corresponding arcuate inlet segment 378 of approximately 330° length and a corresponding arcuate outlet segment 380 of approximately 180°, the inlet segment overlapping approximately 150° of the outlet segment. Configuration of the segments 378 and 380 is adapted for converting the pumping apparatus to a vacuum pump.

Operation of the gas compressor, gas expander and vacuum pump (FIGS. 28*a–c*) is substantially as described above for the pumping apparatus, rotation of the members 86*a* and 88*a* to which the segments 370, 374 and 378 and 372, 376 and 380 are attached causing opening and closing of inlet and outlet ends of the rotor openings 320–326 according to the pressure (openings closed) or absence (openings open) of such segments.

VARIATION OF FIG. 29:

As described above, flow of fluid or gases through the pump 300 is from the inlet plenum 130*a*, through the pumping portion and out through the outlet plenum 134*a*. Control of fluid or gas flow through the rotor passages 320–326 and 340–346 is accomplished by configuration of the shaft members 86*a* and 88*a*, which are rotated relative to the rotor 68*a* as the rotor is turned by the shaft 22*a*.

Other means may, however, be alternatively provided for admitting fluid or gases into the pumping chambers 160*a*–166*a* and for discharging the pressurized fluid or gases therefrom. Hence, the above-described flow control means are not considered to be limiting.

Figure 29:
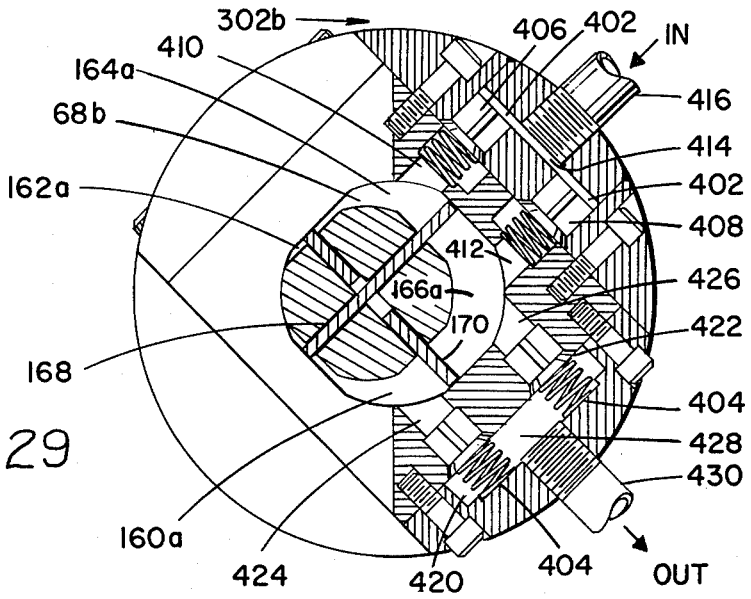
FIG. 29 is a transverse cross sectional view through the rotor portion, of a variation pump showing alternative means for controlling flow of fluid or gases into and out of the pump.

As an illustration of an alternative type of fluid or gas flow control means, FIG. 29 illustrates, for a variation pump 300*b*, flow control means 400. The variation pump 300*b* is, except for the substitution of the control means 400 for the above-summarized flow control means, identical in all respects with the pump 300. Thus, in the variation pump 300*b*, the plenums 130*a* and 134*a*, as well as the passages 320–326 and 340–346 have been eliminated. Also there is no need for the particular described configuration of the shaft members 86*a* and 88*a*.

Since the variation pump 300*b* is similar in most respects to the described pump 300, only the differences relating to flow control of the fluid or gases being pumped will be described. Also, for purposes of clarity, new elements or features of the pump 300*b* are given new reference numbers starting with reference number 400. Similar, corresponding but modified or changed features or elements are identified by the letter "b" following the reference number. Unchanged parts are given the original reference numbers.

In general, the pump 300*b* means for flow control 400 employs a plurality of spring loaded check valves or poppet valves—one set of inlet valves 402 being employed for enabling inflow of fluid or gases to the four pumping chambers 160a–166a and another set of outlet valves 404 being employed for enabling outflow of pressurized fluid or gases from such pumping chambers (FIG. 29). The pumping chambers 160a–166a in the above-described manner, are formed by a rotor 68b the vane 168 and 170 and a central housing portion 302b.

The set of inlet valves 402 comprises four inlet poppet valves, only first and second inlet valves 406 and 408 being shown. The first valve 406 communicates with the third chamber 164a and the second valve 408 communicates with the fourth chamber 166a, through respective passages 410 and 412. Two similar inlet valves are provided, at an opposite side, for the chambers 160a and 162a. A common inlet chamber 414 interconnects the valves 406 and 408 to an inlet line 416.

In an entirely similar means, the set of outlet valves 404 includes four outlet poppet valves, only first and second valves 420 and 422, connected respectively to the pumping chambers 160a and 166a through passages 424 and 426. A common exhaust or outlet chamber 428 interconnects both the valves 420 and 422 with an outlet line 430.

Spring settings of the valves in the sets 402 and 404 are preset, in a well known manner to enable proper inletting and outletting of fluid or gases into and from the chambers 160a–166a as is required for pumping.

Configuration of the valves in the sets of 402 and 404 and of the associated passages into the chambers 160a–166a (passages 410, 412 and 424, 426 being illustrated) is according to well known valve principles and hence need not be described. However, the cross-section of such passages into the chambers 160a–166a may be formed, in cross-section, with a "Y-shaped" valve support web (not shown) to support the associated valves.

Although there has been described above specific arrangement of an orbital internal combustion engine and an orbital pump, compressor, hydraulic motor or vacuum pump and variations thereof in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Orbital-type apparatus, which comprises:

(a) a generally cylindrical housing having a circumferential wall portion and opposing first and second transverse end walls and having therebetween an annular wall member, inwardly projecting from the circumferential wall portion;

(b) a generally spool shaped rotor having a central portion and first and second transverse ends which include, respectively, first and second radially projecting annular flanges, said rotor being configured and disposed in the housing to have side surfaces of said first and second flanges in close proximity to corresponding first and second transverse side surfaces of the annular wall member respectively, a central compression chamber being formed between said first and second rotor flanges and fluid and gas inlet and outlet plenum chambers being formed, respectively, between the first rotor flange and the housing first end wall and between the second rotor flange and the housing second end wall, (c) a drive shaft journaled for axial rotation in the housing, at least a portion of the shaft extending to axial ends of the rotor;

(d) connecting means for axially rotatably connecting the rotor to the drive shaft with an axial rotational axis of the rotor radially displaced from the rotational axis of the shaft to thereby cause central portions of the rotor to orbit about the central compression chamber when the rotor rotates relative to the drive shaft axis;

(e) a plurality of vanes mounted through the rotor, said vanes dividing the central compression chamber into a plurality of pumping sub-chambers which change volume as the rotor orbits about the drive shaft axis, each of said vanes extending diametrically through the rotor and being mounted for independent sliding movement relative to the rotor, each of the vanes being configured so that opposite ends thereof are always in tangential sliding contact with opposite, parallel inner wall regions of the housing as the rotor orbits about the central compression chamber;

(f) means for controlling inlet flows of fluids and gases from the inlet plenum into the pumping subchambers and for controlling outlet discharge of fluids and gas from the pumping subchambers into the outlet plenum, said flow controlling means including a plurality of spring loaded poppet valves; and (g) a bell crank connected between the housing and the rotor for controlling orbital movement of the rotor relative to the housing.

2. The apparatus as claimed in claim 1, wherein said plurality of vanes comprises first and second vanes installed completely through the rotor in mutual orthogonal relationship, each of the vanes having opposite end portions extending radially outwardly from the rotor, the first vane being formed in a central region to enable the second vane to slide therethrough, said vanes dividing the central chamber into four pumping subchambers.

3. The apparatus as claimed in claim 2, wherein the central chamber, in the region of the vanes, is formed having a generally square, transverse cross section as defined by inner walls of the housing, and wherein the rotor is configured and connected to the drive shaft to cause the vanes to be substantially orthogonal to said inner walls for all orbital positions of the rotor, outer ends of the vanes thereby being caused to reciprocate tangentially along said inner walls as the rotor orbits about the central chamber.

4. The apparatus as claimed in claim 3, including sealing means for sealing ends of the vanes relative to inner walls of the housing and side edges of the vanes relative to adjacent transverse surfaces of the annular wall member.

5. The apparatus as claimed in claim 4, wherein the sealing means includes sealing means between the vanes and adjacent inner surfaces of the rotor for preventing leakage through the rotor past the vanes.

6. The apparatus as claimed in claim 4, wherein the sealing means includes sealing between the rotor flanges and the wall member for preventing leakage into and from the pumping sub-chambers.

7. The apparatus as claimed in claim 1, wherein the drive shaft comprises axially separated first and second shaft segments, said first shaft segment being journalled for rotation in the housng first end wall and having an inner end relatively adjacent to the rotor first end, said second shaft segment being journalled for rotation in said housing second end wall and having an inner end relatively adjacent to the rotor second end.

8. The apparatus as claimed in claim 7, wherein the connecting means includes a first rotor mounting member fixed to the inner end of the first shaft segment and a second rotor mounting member fixed to the inner end of the second shaft segment, said connecting means further including axial rotor projections journalled for rotation in said first and second mounting members.

* * * * *